US007669978B2

(12) United States Patent
Spivey et al.

(10) Patent No.: US 7,669,978 B2
(45) Date of Patent: Mar. 2, 2010

(54) INKJET PRINTHEAD PACKAGING TAPE FOR SEALING NOZZLES

(75) Inventors: Paul T. Spivey, Lexington, KY (US); William B. Rose, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 339 days.

(21) Appl. No.: 11/699,295

(22) Filed: Jan. 29, 2007

(65) Prior Publication Data

US 2007/0120890 A1 May 31, 2007

Related U.S. Application Data

(63) Continuation of application No. 10/775,939, filed on Feb. 10, 2004, now Pat. No. 7,219,979.

(51) Int. Cl.

| | |
|---|---|
| ***B41J 2/05*** | (2006.01) |
| ***B41J 2/14*** | (2006.01) |
| ***B41J 2/16*** | (2006.01) |
| ***B41J 2/175*** | (2006.01) |

(52) U.S. Cl. ..... 347/59; 347/47; 347/86

(58) Field of Classification Search ..... 347/92; 206/387.1, 723

See application file for complete search history.

(56) References Cited

U.S. PATENT DOCUMENTS

| | | | | |
|---|---|---|---|---|
| 5,131,539 | A | 7/1992 | Karita et al. | |
| 5,244,087 | A | 9/1993 | Hikake et al. | |
| 5,244,092 | A | 9/1993 | Karita et al. | |
| 5,262,802 | A | 11/1993 | Karita et al. | |
| 5,279,410 | A | 1/1994 | Arashima et al. | |
| 5,400,060 | A | 3/1995 | Carlotta | |
| 5,414,454 | A * | 5/1995 | Reid | 347/29 |
| 5,500,660 | A * | 3/1996 | Childers et al. | 347/33 |
| 5,667,063 | A | 9/1997 | Abe | |
| 5,701,995 | A | 12/1997 | Higuma et al. | |
| 5,781,208 | A | 7/1998 | Karita et al. | |
| 5,812,166 | A | 9/1998 | Yamazaki | |
| 5,831,652 | A | 11/1998 | Hinami | |
| 5,850,238 | A | 12/1998 | Karita et al. | |
| 5,917,514 | A | 6/1999 | Higuma et al. | |
| 5,934,475 | A | 8/1999 | Hikake et al. | |
| 5,940,104 | A | 8/1999 | Karita et al. | |
| 6,047,816 | A | 4/2000 | Moghadam | |
| 6,283,587 | B1 | 9/2001 | Umemura | |
| 6,286,946 | B1 | 9/2001 | Umemura | |
| 6,412,933 | B2 | 7/2002 | Umemura | |
| 6,502,701 | B2 | 1/2003 | Shinada | |

(Continued)

*Primary Examiner*—Matthew Luu
*Assistant Examiner*—Lisa M Solomon

(57) ABSTRACT

An inkjet printhead has a body and a heater chip attached thereto. A nozzle plate on the heater chip includes a periphery and plurality of nozzle holes. An encapsulant bead lines the periphery of the nozzle plate and has a leading edge extending in a direction away from the periphery toward the plurality of nozzle holes. The boundary of the bead embodies an irregular shape and the leading edge exists less than about 500 microns from any of the nozzle holes. A tape attaches to the nozzle plate and covers each of the nozzle holes. The tape does not, however, touch the encapsulant bead. Preferably, the tape has a narrow width portion shorter than a width of the nozzle plate. In this manner, the encapsulant bead may encroach upon the nozzle holes closer than heretofore known. In turn, the heater chip can have reduced size and silicon savings.

14 Claims, 11 Drawing Sheets

U.S. PATENT DOCUMENTS 6,533,405 B1 3/2003 Sleger
6,588,875 B1 7/2003 Kleinhammer
6,634,732 B2 10/2003 Farr
2002/0140763 A1 10/2002 Nelson

* cited by examiner

INKJET PRINTHEAD PACKAGING TAPE FOR SEALING NOZZLES

This application claims priority and benefit as a continuation application of U.S. application Ser. No. 10/775,939 filed on Feb. 10, 2004, now U.S. Pat. No. 7,219,979 entitled "Inkjet Printhead Packaging Tape for Sealing Nozzles."

FIELD OF THE INVENTION

The present invention relates generally to inkjet printheads. In particular, it relates to packaging tapes sealed over printhead nozzle plates, in turn, disposed on printhead heater chips. In one aspect, it relates to packaging tape shape and orientation that enables encapsulant beads to occupy nozzle plate area relative to nozzle holes closer than heretofore known. In another aspect, it relates to enabling shrinking heater chip size to save on silicon costs.

BACKGROUND OF THE INVENTION

The art of inkjet printhead manufacturing is well known. In general, a printhead has a housing or body that defines an interior filled with one or more inks. A heater chip or other semiconductor die attaches to the body and resides in fluid communication with the one or more inks. A nozzle plate, attached to or formed with the heater chip, has a plurality of nozzle holes in communication with the heaters of the chip that serve, during use, to eject ink. After manufacture, and before use, however, the printhead must become packaged for shipping. Yet, during shipping, the printhead often experiences extreme environmental conditions, e.g., enormous temperature and pressure swings. Thereafter, it may remain packaged for a considerable length of time. Consequently, printhead packaging must contemplate reliability and durability.

With reference to FIG. 1, a printhead 10 with a nozzle plate 12 typically has a packaging tape 14 covering the individual nozzle holes 16 of the plate to prevent ink leakage during shipping and handling. Unfortunately, with reference to FIG. 2, the encapsulant beads 18 adjacent the nozzle plate regularly act as tent poles for the tape and, over time or immediately, cause the tape to lift off the nozzle plate in regions 20 and un-seal the nozzle holes 16. Eventually, this causes the printhead to leak.

To minimize this possibility, manufacturers have tried applying the encapsulant beads 18 as close as possible to their preferred placement position 24 (dashed line). In theory, this placement position extends from an edge 26 of the KAPTON of a TAB (tape automated bonded) circuit to an edge 28 of the nozzle plate and covers otherwise exposed portions of a lead beam 30 of the TAB circuit. Appreciating that tolerance stack-up issues abound in theoretically applying an encapsulant bead, and accurately placing a nozzle hole 16, producers of inkjet printheads often create large-as-necessary distances d1,d2 between the edge of the nozzle holes and the edge of the encapsulant bead to accommodate the tolerances. This, however, adversely limits a producer's ability to reduce the size of its heater chip 22 and attendant nozzle plate. While this did not, perhaps, create much of a problem in the past when heater chips tended to incorporate NMOS technology, as the future of heater chips appears to embrace CMOS technology, any prevention in reducing the size of the heater chip increases manufacturing costs, especially silicon costs.

Accordingly, the art of printhead manufacturing has a need for minimizing manufacturing costs, especially minimizing silicon-related expenses. Simultaneously, it also has need of creating and utilizing printhead packaging reliable throughout a variety of environmental conditions while durable for extended periods of time.

SUMMARY OF THE INVENTION

The above-mentioned and other problems become solved by applying the principles and teachings associated with the hereinafter-described packaging tape for sealing inkjet printhead nozzles. Preferably, the packaging tape has shapes and orientations that allow encapsulant beads to occupy nozzle plate areas closer to nozzle holes than heretofore known. In turn, manufacturers can shrink the size of their heater chips and save on silicon costs. In one embodiment, an inkjet printhead has a body and a heater chip attached thereto. A nozzle plate on the heater chip includes a periphery and plurality of nozzle holes. An encapsulant bead lines the periphery of the nozzle plate and has a leading edge extending in a direction away from the periphery toward the plurality of nozzle holes. The boundary of the bead has an irregular shape and a leading edge thereof exists less than about 500 microns from any of the nozzle holes. In other embodiments, the encapsulant bead exists in a range between about 100 and about 400 microns. More preferably, it exists in a range of about 200 to about 300 microns. A piece of packaging tape attaches to the nozzle plate and covers each of the nozzle holes. The tape does not, however, touch the encapsulant bead. In this manner, the encapsulant bead may encroach upon the nozzle holes closer than heretofore known.

In other embodiments, the tape has a narrow width portion shorter than a width of the nozzle plate. It may also have a wide portion wider than the width of the nozzle plate. In various designs, the shape embodies an hourglass, an oar or a rectangle. When the tape is exclusively a rectangle, no portion thereof exceeds the width of the nozzle plate.

The tape also has an edge. The leading edge of the encapsulant bead preferably exists in a range of about 100 to about 450 microns from this edge. The edge of the tape extends more than about 50 microns from any nozzle hole of the nozzle plate.

In a variety of other embodiments, the tape is a two-layer structure of poly vinyl chloride and acrylic. The tape may also have a user tab for grasping. Inkjet printers are also disclosed for housing the inkjet printheads.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained according to the following description and as particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized and that process or other changes may be made without departing from the scope of the present invention. The following detailed description is, therefore, not to be taken in a limiting sense, and the scope of the present invention is defined only by the appended claims and their equivalents. In accordance with the present invention, packaging tape for sealing nozzle holes of inkjet printheads, to ultimately enable reduced sized heater chips, is hereinafter described. The packaging tape also enables extremely close placement of an encapsulant bead relative to the nozzle holes.

Figure 8:
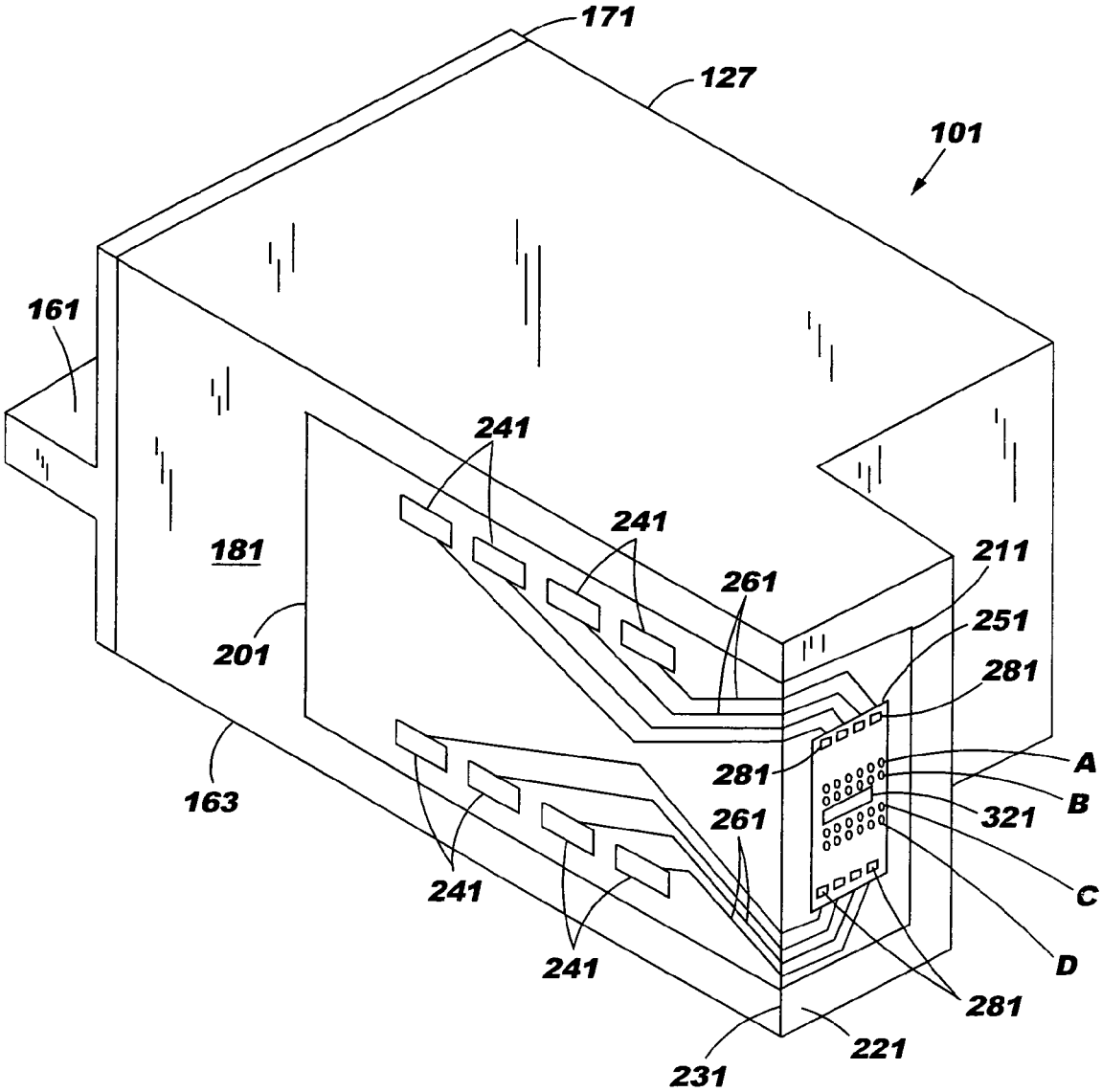
FIG. 8 is a perspective view in accordance with the present invention of an inkjet printhead before being packaged with a nozzle plate sealing tape.

With reference to FIG. 8, an inkjet printhead of the present invention to-be-packaged with a nozzle hole sealing tape is shown generally as 101. The printhead 101 has a housing 127 formed of a lid 161 and a body 163 assembled together through attachment or connection of a lid bottom surface and a body top surface at interface 171. The shape of the housing varies and depends upon the external device that carries or contains the printhead, the amount of ink to be contained in the printhead and whether the printhead contains one or more varieties of ink. In any embodiment, the housing or body has at least one compartment in an interior thereof for holding an initial or refillable supply of ink and a structure, such as a foam insert, lung or other, for maintaining appropriate back-pressure in the inkjet printhead during use. In one embodiment, the internal compartment includes three chambers for containing three supplies of ink, especially cyan, magenta and yellow ink. In other embodiments, the compartment contains black ink, photo-ink and/or plurals of cyan, magenta or yellow ink. It will be appreciated that fluid connections (not shown) may exist to connect the compartment(s) to a remote source of bulk ink.

A portion 191 of a tape automated bond (TAB) circuit 201 adheres to one surface 181 of the housing while another portion 211 adheres to another surface 221. As shown, the two surfaces 181, 221 exist perpendicularly to one another about an edge 231. The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. As will be shown below, the connections further embody a lead beam and a KAPTON cover and the lead beam extends onto a surface of the heater chip. It will be appreciated that while eight I/O connectors 241, eight electrical conductors 261 and eight bond pads 281 are shown, any number are embraced herein. It is also to be appreciated that such number of connectors, conductors and bond pads may not be equal to one another.

The heater chip 251 contains at least one ink via 321 that fluidly connects to a supply of ink in an interior of the housing. Typically, the number of ink vias of the heater chip corresponds one-to-one with the number of ink types contained within the housing interior. The vias usually reside side-by-side or end-to-end. During printhead manufacturing, the heater chip 251 preferably attaches to the housing with any of a variety of adhesives, epoxies, etc. well known in the art. As shown, the heater chip contains four rows (rows A-row D) of fluid firing elements, especially resistive heating elements, or heaters. For simplicity in this crowded figure, dots depict the heaters in the rows and typical printheads contain hundreds of heaters. It will be appreciated that the heaters of the heater chip preferably become formed as a series of thin film layers made via growth, deposition, masking, photolithography and/or etching or other processing steps. A nozzle plate, shown in other figures, with pluralities of nozzle holes adheres over or is fabricated with the heater chip during thin film processing such that the nozzle holes align with the heaters for ejecting ink during use. Alternatively, the heater chip is merely a semiconductor die that contains piezoelectric elements, as the fluid firing elements, for electro-mechanically ejecting ink. As broadly recited herein, however, the term heater chip will encompass both embodiments despite the name "heater" implying an electro-thermal ejection of ink. Even further, the entirety of the heater chip may be configured as a side-shooter structure instead of the roof-shooter structure shown.

Figure 7A:
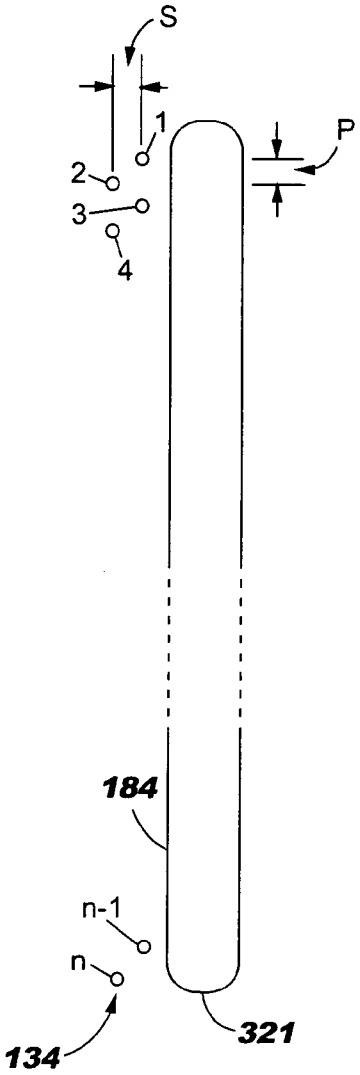
FIGS. 7*a*-7*c* are planar views in accordance with the present invention of alternate arrangements of nozzle holes of a nozzle plate.
Figure 7B:
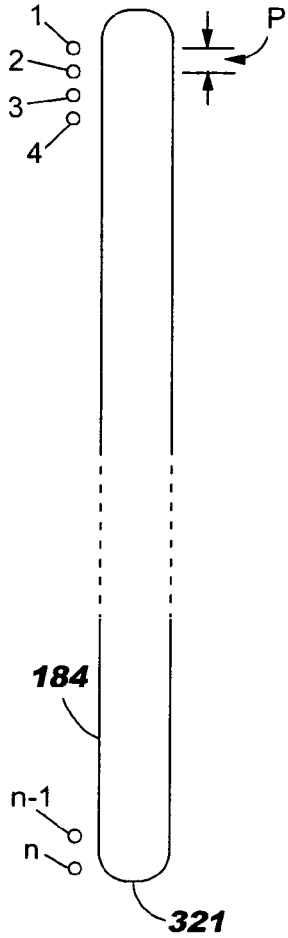
Figure 7C:
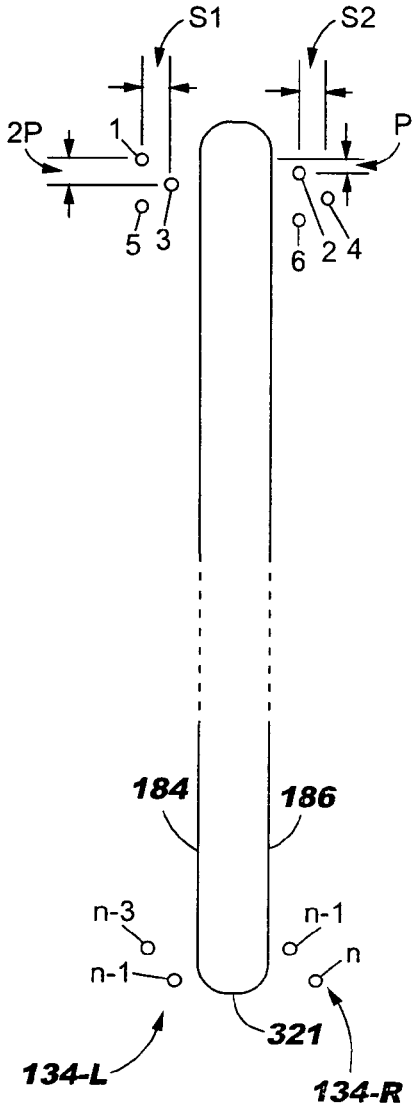

As will be further described in relation to the nozzle holes of FIGS. 7*a*-7*c*, vertically adjacent ones of the fluid firing elements may or may not have a lateral spacing gap or stagger there between. In general, however, the fluid firing elements have vertical pitch spacing comparable to the dots-per-inch resolution of an attendant printer. Some examples include spacing of $1/300^{th}$, $1/600^{th}$, $1/1200^{th}$, $1/2400^{th}$ or other of an inch along the longitudinal extent of the via. To form the vias, many processes are known that cut or etch through a thickness of the heater chip. Some of the more preferred processes include grit blasting or etching, such as wet, dry, reactive-ion-etching, deep reactive-ion-etching, or other.

Figure 9:
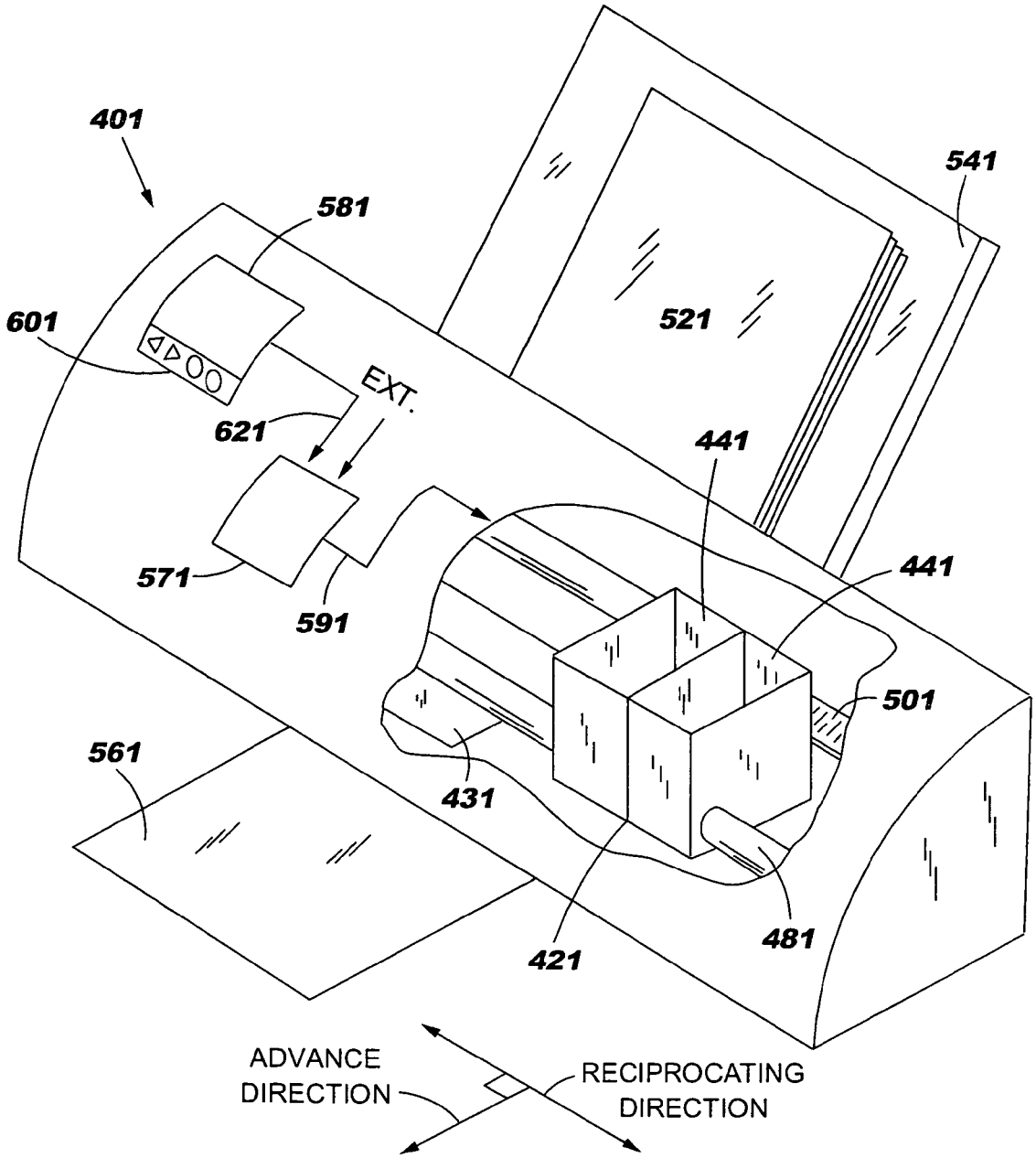
FIG. 9 is a perspective view in accordance with the present invention of an inkjet printer for housing an inkjet printhead after removal of its packaging tape.

With reference to FIG. 9, an external device in the form of an inkjet printer, for containing the printhead 101 after removal of the packaging tape, is shown generally as 401. The printer 401 includes a carriage 421 having a plurality of slots 441 for containing one or more printheads. The carriage 421 is caused to reciprocate (via an output 591 of a controller 571) along a shaft 481 above a print zone 431 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 431, to an output tray 561.

In the print zone, the carriage 421 reciprocates in the Reciprocating Direction generally perpendicularly to the paper Advance Direction as shown by the arrows. Ink drops from the printheads are caused to be ejected from the heater chip 251 (FIG. 8) at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other. A control panel 581 having user selection interface 601 may also provide input 621 to the controller 571 to enable additional printer capabilities and robustness.

To print or emit a single drop of ink, the fluid firing elements (the dots of rows A-D, FIG. 8) are uniquely addressed with a small amount of current to rapidly heat a small volume of ink. This causes the ink to vaporize in a local ink chamber and be ejected through the nozzle plate towards the print medium. The fire pulse required to emit such ink drop may embody a single or a split firing pulse and is received at the heater chip on an input terminal (e.g., bond pad 281) from connections between the bond pad 281, the electrical conductors 261, the I/O connectors 241 and controller 571. Internal heater chip wiring conveys the fire pulse from the input terminal to one or many of the fluid firing elements.

Once manufactured, the inkjet printhead of the present invention requires its nozzle plate, especially nozzle holes, to become sealed with a packaging tape for shipping and handling operations. Referring to FIGS. 3*a*-3*d*, a tape in accordance with the present invention for sealing the nozzle holes is generally shown as 11. In various embodiments, the tape has a narrow-width portion 13 and may or may not have a wide portion 15. As will be hereafter shown, the narrow-width portion 13 attaches to the nozzle plate and seals or covers each of the nozzle holes. The narrow-width portion does not, however, exceed a width of the nozzle plate thereby allowing an encapsulant bead to lie on the nozzle plate and encroach upon the nozzle holes in a distance closer than heretofore known. In embodiments with a wide portion 15, the wide portion preferably exceeds the width of the nozzle plate to provide more adhering surface area when fashioned on a body of the printhead. A dashed line 17 shows the difference between prior art packaging tapes and the tape 11 of the instant invention. A user tab 19 may also be fashioned at an end of the tape for grasping and removing the tape after shipping, but before use.

Figure 1:
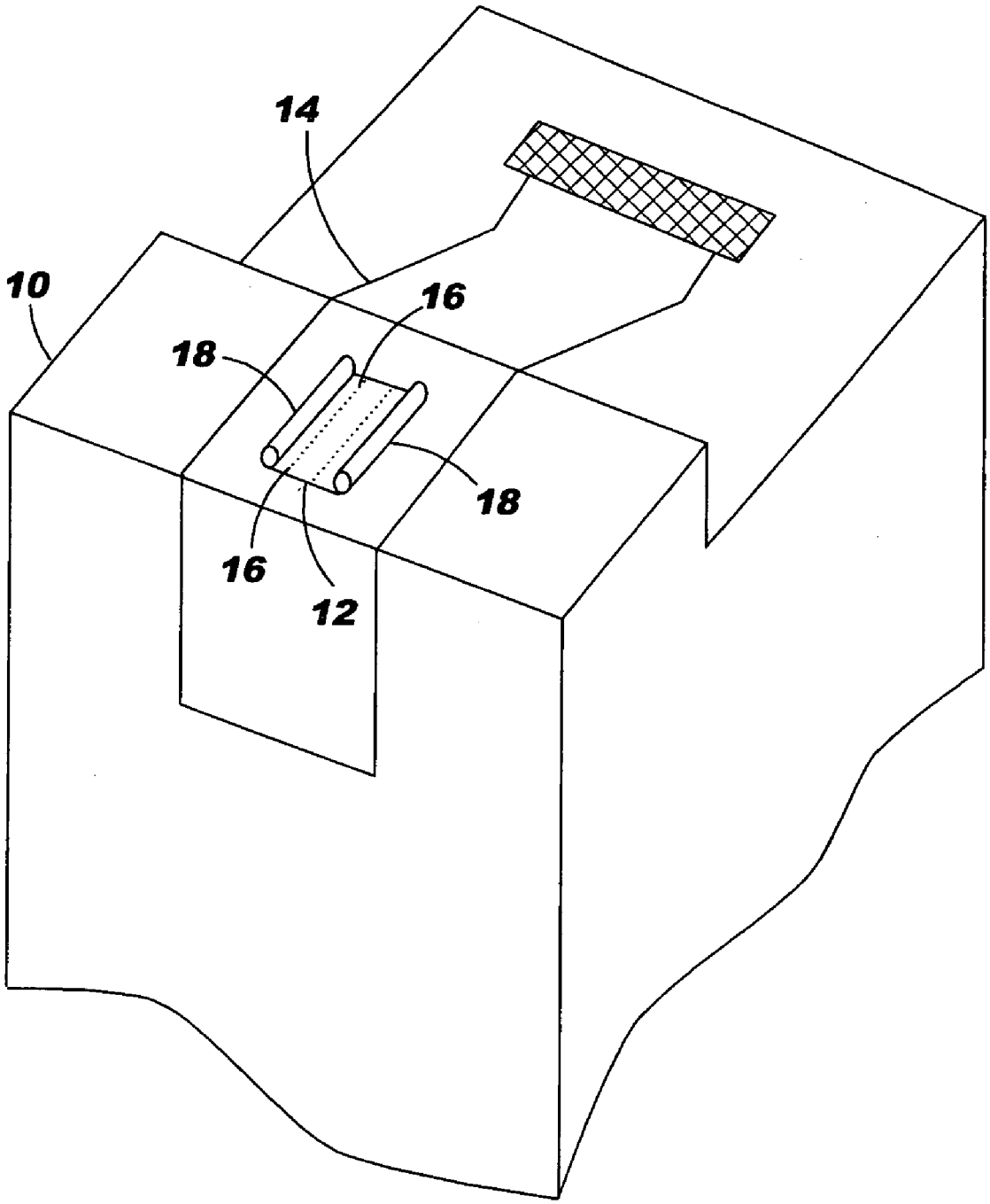
FIG. 1 Prior Art
FIG. 1 is a perspective view in accordance with the prior art of an inkjet printhead packaged with a tape sealing the nozzle holes of a nozzle plate.
Figure 2:
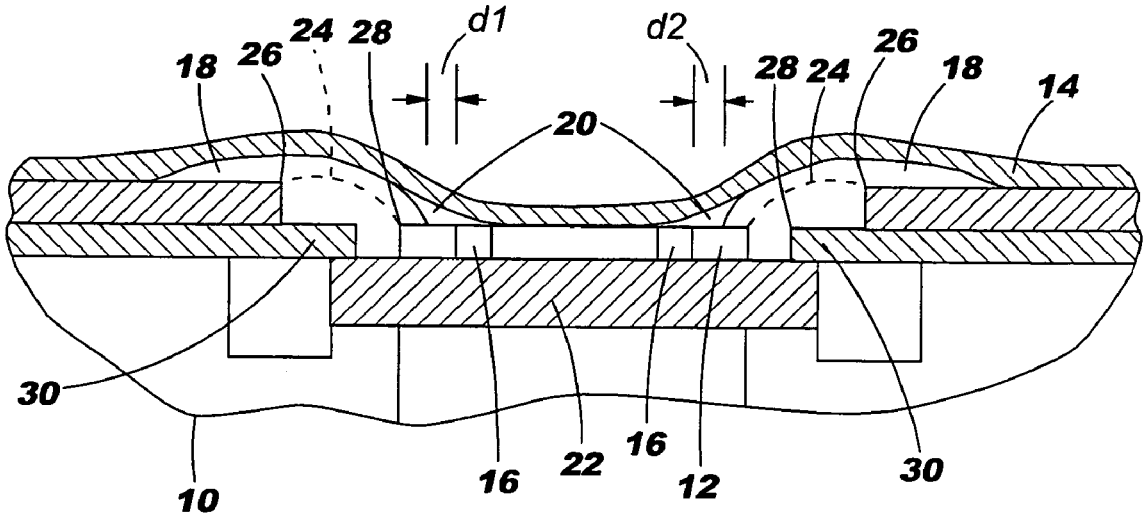
FIG. 2 Prior Art
FIG. 2 is a cross sectional view in accordance with the prior art of the tape of FIG. 1 lifted-off the nozzle holes of the nozzle plate, thereby unsealing them.
Figure 3A:
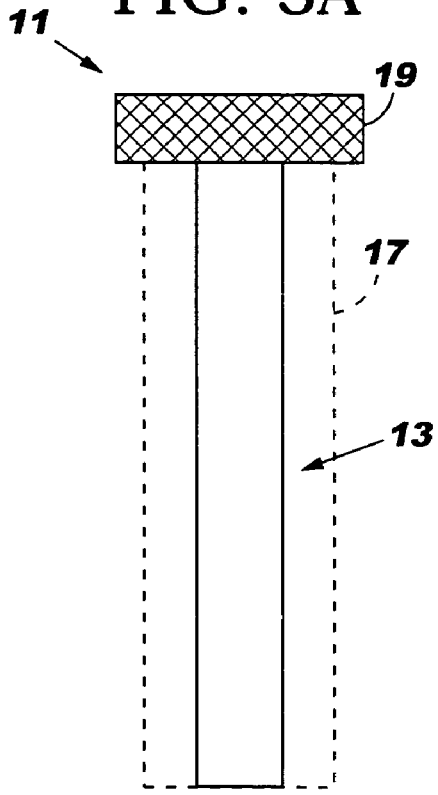
FIGS. 3*a*-3*d* are planar views in accordance with the present invention of a tape for sealing nozzle holes of a nozzle plate during packaging of an inkjet printhead.
Figure 3B:
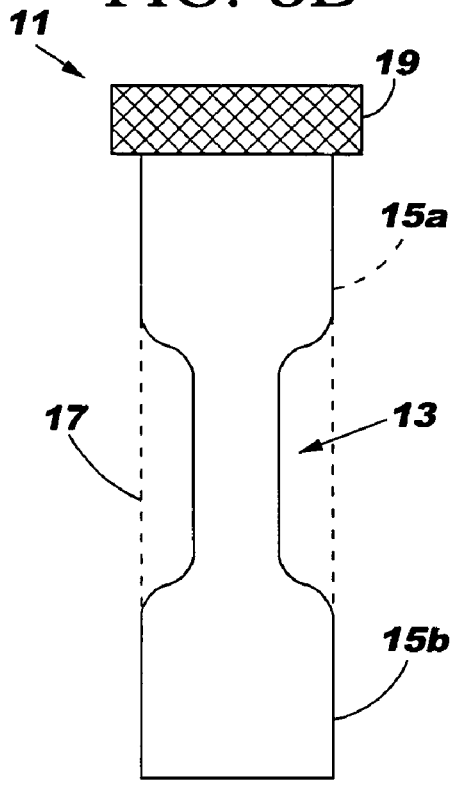
Figure 3C:
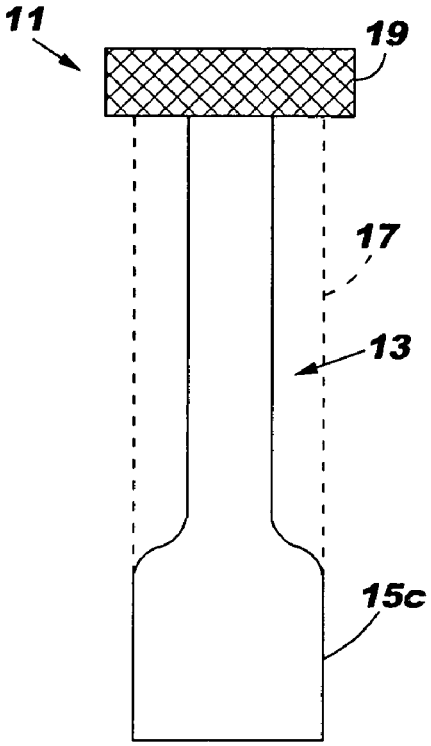
Figure 3D:
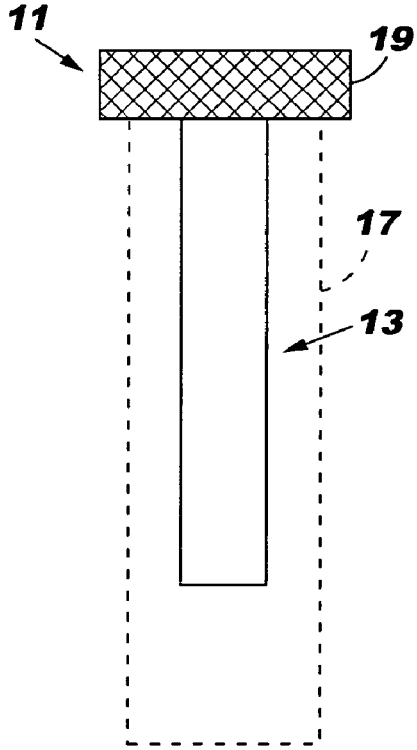

In more detail, FIG. 3*a* shows a generally rectangular tape 11 having its entire longitudinal extent corresponding to the narrow-width portion 13. When fashioned in this manner, no portion thereof exceeds the width of the nozzle plate. FIG. 3*b*, shows a tape having an overall hourglass shape whereby the narrowed-width portion 13 roughly occupies a middle third of the tape length. On either ends thereof, wide portions 15*a* and 15*b* occupy top and bottom thirds of the tape length. In FIG. 3*c*, the tape 11 has an oar-shape whereby the narrow width portion 13 roughly occupies two-thirds of the length of the tape while a wide portion 15*c* occupies the remaining third. To provide a reference, the tape length in each of FIGS. 3*a*-3*c* corresponds to about 2.5 inches. FIG. 3*d* shows a tape 11 having the same overall appearance as the tape of FIG. 3*a* with the exception that the tape is shorter in length. Those skilled in the art, however, will appreciate that the invention embraces other shapes of tapes and the invention is not limited to just those shown. For example, tapes with wide portions 15 need not have a width thereof that corresponds to the width of prior art packaging tapes as shown by dashed line 17. As taught herein, the wide portion 15 can exceed, or not, the width of prior art tapes. As another example, the boundaries of the tapes can include curves, circles, ovals, triangles, or other geometric shapes or other.

Figure 4A:
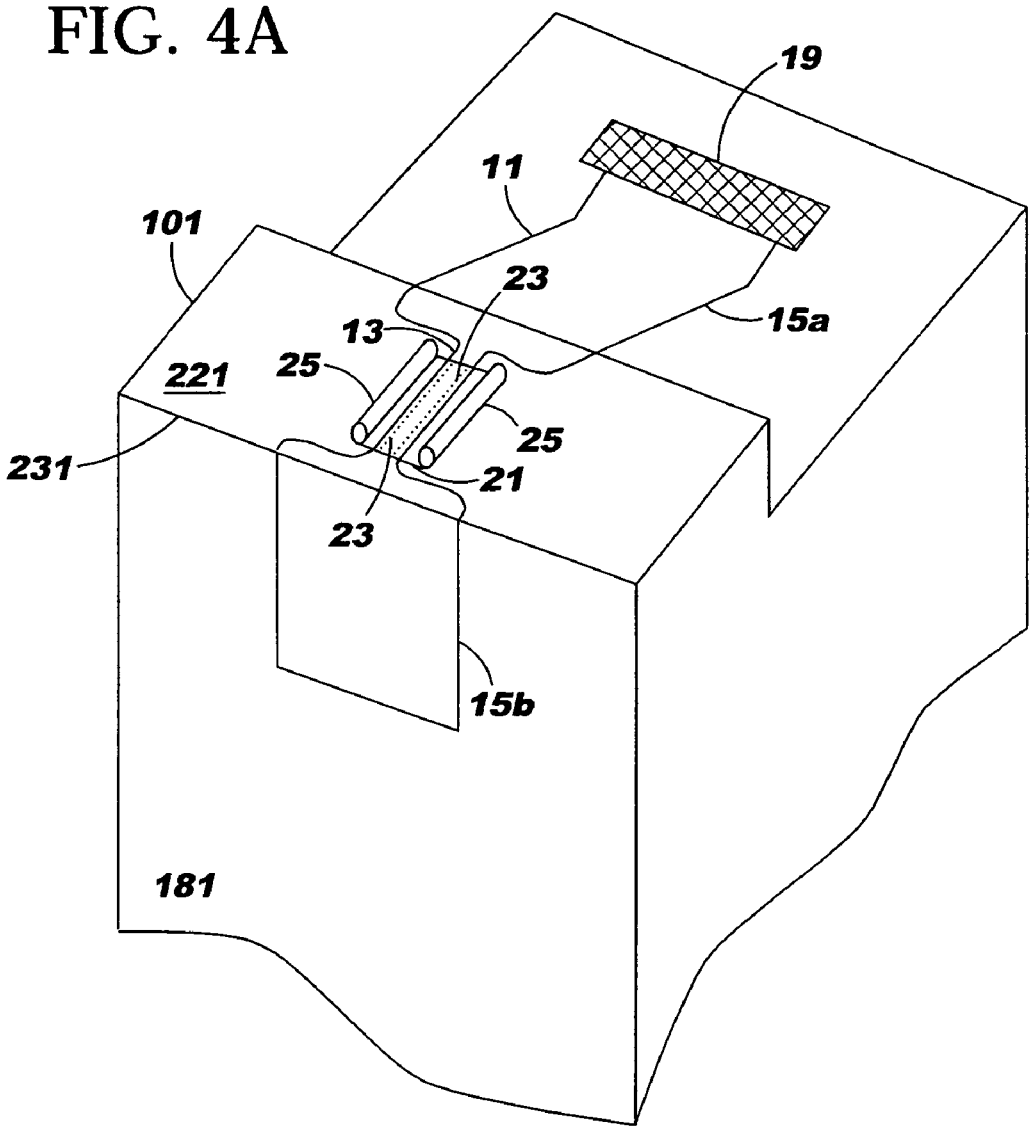
FIG. 4*a* is a perspective view in accordance with the present invention of an inkjet printhead nozzle plate sealed with the tape of FIG. 3*b;*
Figure 5A:
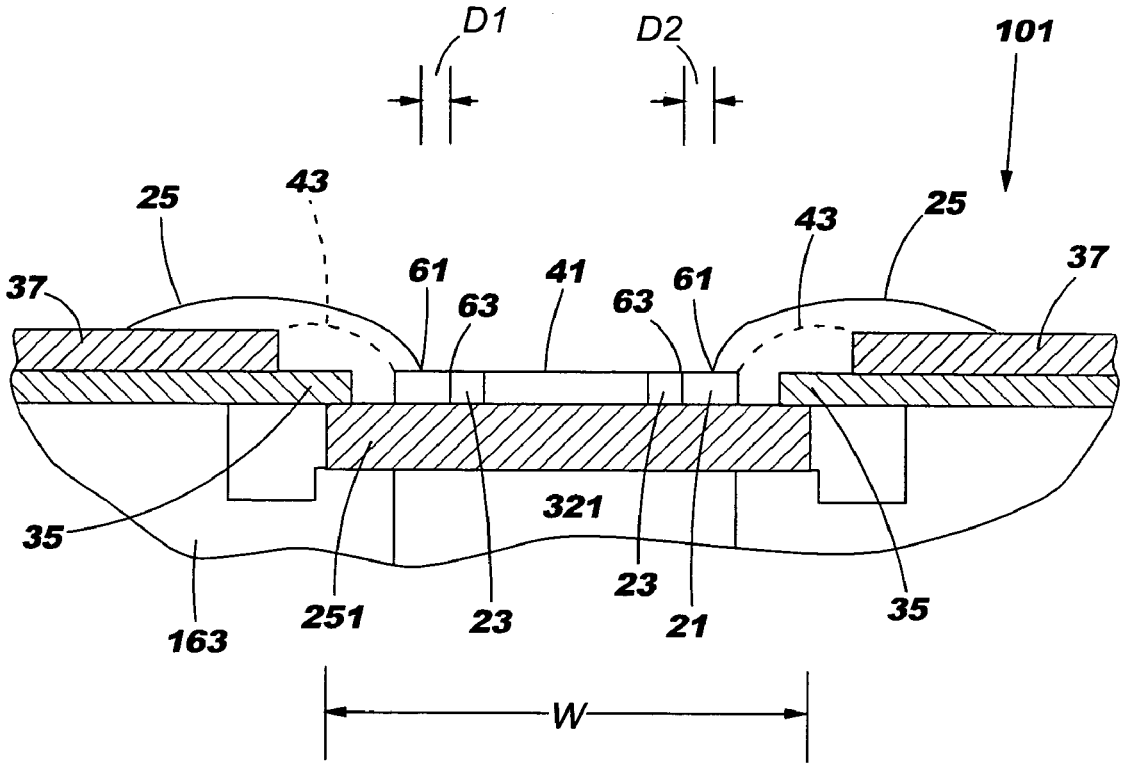
FIG. 5*a* is a cross sectional view in accordance with the present invention of encapsulant beads relative to nozzle holes of a nozzle plate.
Figure 5B:
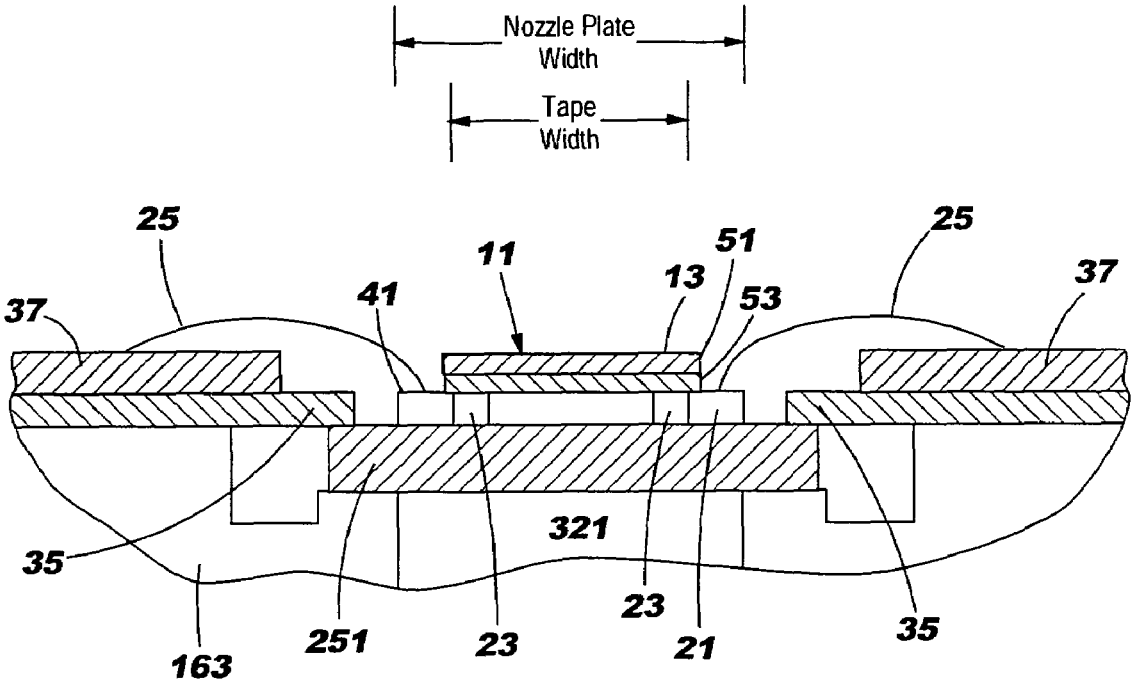
FIG. 5*b* is a cross sectional view in accordance with the present invention of encapsulant beads relative to nozzle holes of a nozzle plate according to FIG. 5*a* and including a tape sealing the nozzle holes for shipping and handling.

In FIG. 4*a*, the tape 11 of FIG. 3*b* is shown sealed over the nozzle plate 21, especially each of the nozzle holes 23, of the inkjet printhead 101. Because the tape 11 has a narrow-width portion 13 that does not exceed a width of the nozzle plate (FIG. 5*b*), the encapsulant beads 25 may now overlie a periphery of the nozzle plate and encroach upon the nozzle holes in shorter distances heretofore known without negative repercussions of the encapsulant beads causing tenting of the tape relative to the nozzle plates, especially the lifting of the tape and the unsealing of the nozzle holes 23. In a preferred embodiment, the wide portion 15*a* necks-down or tapers to the narrow-width portion 13 on the surface 221 of the printhead 101. It will also neck-up from the narrow-width portion 13 to the wide portion 15*b* on the same surface. To substantially eliminate all possibility of the encapsulant beads 25 from lifting the tape 11 from the surface of the nozzle plate and unsealing the nozzle holes 23, it is preferred, but not required, that no portion of the tape will touch any portion of the encapsulant bead. For ease of illustration of the invention, skilled artisans will observe that the printhead shown is a simplified version of the printhead shown in FIG. 8.

Figure 4B:
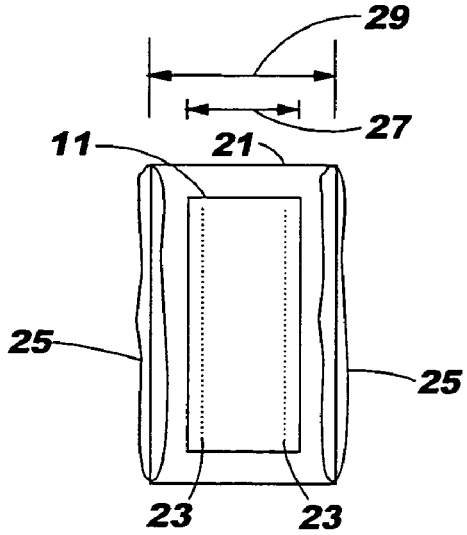
FIG. 4*b* is a planar view in accordance with the present invention of an alternate embodiment of a nozzle plate sealed with a tape during packaging of an inkjet printhead.

In an alternate embodiment of a tape 11 sealing every one of the nozzle holes 23 of a nozzle plate 21, please refer to FIG. 4*b*. As shown, the entirety of tape 11 exclusively includes a narrow-width portion having a width 27 shorter in distance than a width 29 of the nozzle plate. In this manner, the encapsulant beads 25 may lie on the nozzle plate and encroach upon the nozzle holes without the negative repercussions of tape tenting. It is also shown that the tape periphery does not ever extend beyond the nozzle plate periphery and that no portion of either encapsulant bead 25 touches any portion of the tape 11. This, however, is not an absolute requirement to practice the invention.

In cross section (FIGS. 5*a* and 5*b*), the nozzle plate 21 is disposed on the heater chip 251. In turn, the heater chip attaches to the body 163 of the inkjet printhead 101. The lead beams 35 of the TAB circuit extend from the body 163 to electrically and physically attach with the heater chip 321. A KAPTON cover 37 overlies a portion of the lead beams 35. Finally, an encapsulant bead 25 overlies the lead beam 35 to physically and electrically protect it. In one embodiment, the encapsulant bead is an ultraviolet cured epoxy sold as UV 9000 by Emerson & Cummings or 502-39-1 sold by EMS. Preferably, the encapsulant bead 25 extends from the KAPTON cover 37 to the surface 41 of the nozzle plate. In alternate embodiments, the encapsulant bead follows the contour of the dashed line 43 or other. The tape 11 overlies the surface of the nozzle plate 21 and seals the nozzle holes 23 shut for shipping. Preferably, the periphery of the tape does not touch any portion of the encapsulant bead. The tape may also embody a two-layer structure having a poly vinyl chloride layer 51 over an acrylic layer 53. Preferably, it has an overall thickness of 75 microns +/−10 microns.

At this point, skilled artisans should appreciate that the invention enables the encapsulant bead 25 to become closer to any of the nozzle holes 23 than previously known. In one embodiment, the leading edge 61 of the encapsulant bead resides on the nozzle plate in a distance D1 from an edge 63 of a closest nozzle hole 23 of less than about 500 microns. In other embodiments, the distance D1 ranges between about 100 to about 400 microns with a more preferred range of about 200 to about 300 microns. Consequently, the taping of nozzle holes relative to encroaching encapsulant beads no longer serves as a limit on the heater chip 321. Thus, the heater chip 321 may now have a smaller area, especially a shorter width W and length (not shown) thereby saving on silicon expenses. In turn, the nozzle plate width and length may correspondingly shrink.

Figure 6A:
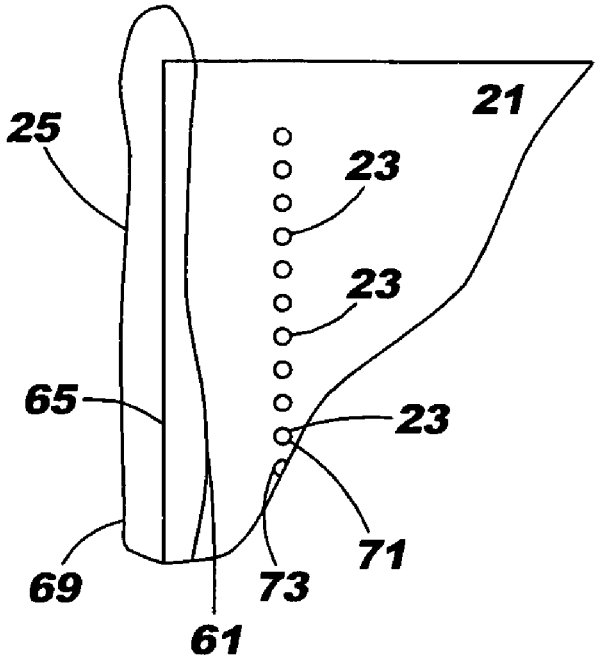
FIG. 6*a* is a partial planar view in accordance with the present invention of a portion of an encapsulant bead positioned relative to nozzle holes of a nozzle plate.
Figure 6B:
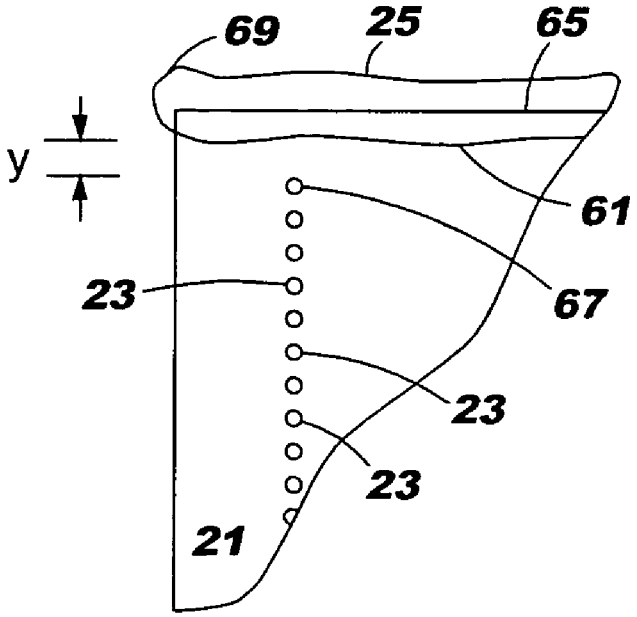
FIG. 6*b* is a partial planar view in accordance with the present invention of an alternate embodiment of an encapsulant bead positioned relative to nozzle holes of a nozzle plate.

In a more detailed planar view with reference to FIG. 6*a*, the encapsulant bead 25 overlies a periphery 65 of the nozzle plate 21 and has an irregular shaped boundary 69. A leading edge 61 thereof extends in a direction preferably away from the periphery 65 in a direction toward the nozzle holes 23 of the nozzle plate. The straight-line distance of the leading edge 61 to the closest nozzle 71 or 73 corresponds to the preferred distance D1 of FIG. 5*a*. Preferably, but not necessarily required, this distance D1 is X and corresponds to the distance substantially perpendicular to the periphery 65 of the nozzle plate from the leading edge 61 to the closest nozzle hole in the row of nozzle holes. Of course, if the heater chip and nozzle plate have an orientation such that the length of the encapsulant bead 25 resides transverse to the row of nozzles as seen in FIG. 6*b*, the closest nozzle hole to the leading edge 61 would correspond to nozzle hole 67. The distance D1 would then be equal to or longer than the distance Y shown.

Figure 6C:
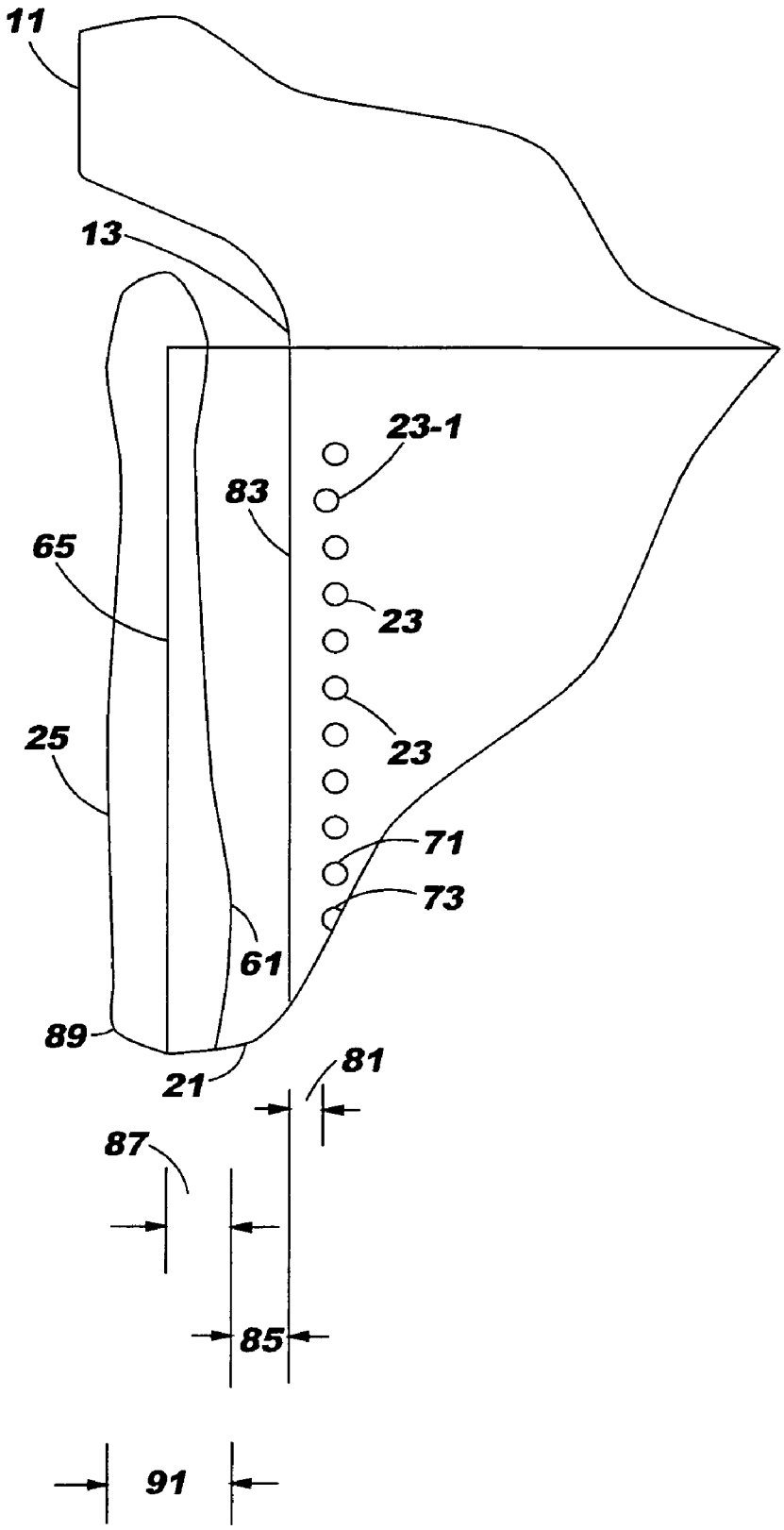
FIG. 6*c* is a partial planar view in accordance with the present invention of a portion of an encapsulant bead positioned relative to a tape that seals nozzle holes of a nozzle plate.

In FIG. 6*c*, the nozzle plate 21 is shown with all of the nozzle holes 23 sealed by a narrow-width portion 13 of a tape 11. A distance 81 exists between an edge 83 of the tape and a closest nozzle hole 23-1 of about 50 microns or more. A second distance 85 exists between the edge 83 of the tape and the leading edge 61 of the encapsulant bead of about 100 to about 450 microns. A third distance 87 between the periphery 65 of the nozzle plate and the leading edge is about 100 to about 200 microns. A preferred nominal width 91 of the encapsulant bead 25 from a trailing edge 89 to the leading edge 61 is about 200 to about 400 microns.

With reference to FIGS. 7A-7C, those skilled in the art will appreciate that any given column of nozzle holes of a nozzle plate will comprise a plurality of nozzle holes representatively numbered 1 through n (FIGS. 7A, 7B) or numbered 1 through n-1 or 2 through n (FIG. 7C) and each may implicate the closest nozzle hole to the leading edge of the encapsulant bead. In FIG. 7A, the nozzle holes of a given column 134 exist exclusively along one side 184 of a longitudinally extending ink via 321 (underneath the nozzle plate) and have a slight horizontal spacing gap S between vertically adjacent ones of fluid firing elements. In a preferred embodiment, the spacing gap S is about $3/1200^{th}$ of an inch. A vertical distance between vertically adjacent ones is the fluid firing element pitch and generally corresponds to the DPI of the printer in which they are used. Thus, preferred pitch includes, but is not limited to, $1/300^{th}$, $1/600^{th}$, $1/1200^{th}$, and $1/2400^{th}$ of an inch. In FIG. 7*b*, the nozzle holes are substantially aligned on a same side of the via with no stagger. They have a pitch P as previously described. In FIG. 7*c*, the nozzle holes exist on either sides 184, 186 of the via 321 in columns 134-L and 134-R and have similar or dissimilar staggers S1, S2 with a pitch P between nozzle holes 1 and 2 and a twice pitch 2P between nozzle holes on a same side of the via.

The foregoing description is presented for purposes of illustration and description of the various aspects of the invention. The descriptions are not intended to be exhaustive or to limit the invention to the precise form disclosed. Nonetheless, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. An inkjet printhead having a body, comprising:

a heater chip on said body;

a nozzle plate on said heater chip, said nozzle plate having a plurality of nozzle holes;

an encapsulant bead on said nozzle plate; and a tape having a narrow-width portion positioned on said nozzle plate covering each of said plurality of nozzle holes, and a wide portion, said narrow-width portion having a width less than a width of said nozzle plate and said wide portion having a width that exceeds said width of said nozzle plate, wherein said narrow-width portion and said wide portions of said tape do not touch said encapsulant bead.

2. The inkjet printhead of claim 1, wherein said narrow-width portion adheres to said nozzle plate.

3. The inkjet printhead of claim 1, wherein said wide portion of said tape tapers to connect to said narrow-width portion.

4. The inkjet printhead of claim 1, wherein said tape is substantially rectangular in shape.

5. The inkjet printhead of claim 1, wherein said wide portion adheres to the body.

6. The inkjet printhead of claim 5, wherein said tape further includes a user tab that does not adhere to the body.

7. The inkjet printhead of claim 1, wherein said tape has an hour-glass shape.

8. An inkjet printhead having a body, comprising:

a heater chip on said body;

a nozzle plate on said heater chip, said nozzle plate having a plurality of nozzle holes;

an encapsulant bead on said nozzle plate; and a tape having a narrow-width portion positioned on said nozzle plate covering each of said plurality of nozzle holes, and a wide portion, said narrow-width portion having a width less than a width of said nozzle plate and said wide portion having a width that exceeds said width of said nozzle plate, wherein no portion of said narrow-width portion and said wide portion of said tape touches said encapsulant bead.

9. The inkjet printhead of claim 8, wherein said narrow-width portion adheres to said nozzle plate.

10. The inkjet printhead of claim 8, wherein said wide portion of said tape tapers to connect to said narrow-width portion outside of periphery of said nozzle plate.

11. The inkjet of claim 8, wherein said wide portion adheres directly to the body.

12. The inkjet printhead of claim 8, wherein said tape includes a user tab that does not adhere to the body.

13. The inkjet printhead of claim 8, wherein said tape has an hour-glass shape.

14. An inkjet printhead having a body, comprising:

a heater chip on the body;

a nozzle plate on the heater chip, the nozzle plate having a plurality of nozzle holes;

an encapsulant bead on the nozzle plate;

a tape disposed on the nozzle plate and covering each of the plurality of nozzle holes, the tape not touching the encapsulant bead;

wherein the nozzle plate is substantially rectangular in shape and has a width, the tape having a narrow-width portion not exceeding the width, the tape further includes a wide portion exceeding the width of the nozzle plate, the wide portion of the tape tapers to connect to the narrow-width portion.

* * * * *